US010130130B2

(12) United States Patent
Roberman et al.

(10) Patent No.: US 10,130,130 B2
(45) Date of Patent: Nov. 20, 2018

(54) MAGNETIC FASTENER ASSEMBLIES

(71) Applicant: Robert Roberman, Vernon Hills, IL (US)

(72) Inventors: Robert Roberman, Vernon Hills, IL (US); Steven Rehkemper, Chicago, IL (US); Adam William Gelder, Oak Lawn, IL (US); Jeffrey Rehkemper, Chicago, IL (US)

( * ) Notice: Subject to any disclaimer, the term of this patent is extended or adjusted under 35 U.S.C. 154(b) by 19 days.

(21) Appl. No.: 15/234,283

(22) Filed: Aug. 11, 2016

(65) Prior Publication Data

US 2018/0042321 A1 Feb. 15, 2018

(51) Int. Cl.

| | |
|---|---|
| ***A41F 1/00*** | (2006.01) |
| ***A44B 1/14*** | (2006.01) |
| ***A45C 13/10*** | (2006.01) |
| ***A44B 1/02*** | (2006.01) |

(52) U.S. Cl.

CPC ..... *A41F 1/002* (2013.01); *A44B 1/02* (2013.01); *A44B 1/14* (2013.01); *A45C 13/1023* (2013.01); *A45C 13/1069* (2013.01); *Y10T 24/32* (2015.01)

(58) Field of Classification Search

CPC .. A41F 1/002; A44B 1/02; A44B 1/14; A45C 13/1023; A45C 13/1069

See application file for complete search history.

(56) References Cited

U.S. PATENT DOCUMENTS

| | | | | |
|---|---|---|---|---|
| 3,008,209 | A | 11/1961 | Kurt | |
| 3,583,041 | A | 6/1971 | Horwitt | |
| 3,919,743 | A | 11/1975 | Cutler | |
| 4,399,595 | A | 8/1983 | Yoon et al. | |
| 6,163,938 | A | 12/2000 | Weber-Unger | |
| 6,216,275 | B1 | 4/2001 | Lee | |
| 6,226,842 | B1 | 5/2001 | Wong | |
| 6,301,754 | B1 | 10/2001 | Grunberger et al. | |
| 6,505,385 | B2 | 1/2003 | Grunberger | |
| 7,320,158 | B2 | 1/2008 | Deto et al. | |
| 2002/0112323 | A1* | 8/2002 | Nire | A41F 1/002 24/303 |
| 2005/0177985 | A1 | 8/2005 | Sjoquist | |

(Continued)

FOREIGN PATENT DOCUMENTS

| | | | |
|---|---|---|---|
| CA | 611939 | A | 4/1961 |
| WO | 2013130022 | A3 | 9/2013 |

*Primary Examiner* — Robert Sandy

*Assistant Examiner* — David M Upchurch

(74) *Attorney, Agent, or Firm* — Brooks Kushman P.C.

(57) ABSTRACT

A clasp assembly is provided. The clasp assembly includes a first clasp member, a second clasp member, a first magnet, and a metallic component. The first clasp member defines a first cavity sized to receive a first portion of a zipper, and defines a first portion extending over the first cavity. The second clasp member defines a second cavity sized to receive a second portion of the zipper, and defines an overhang. The first magnet is secured to one of the first portion of the first clasp member and the overhang of the second clasp member. The metallic component is secured to another of the first portion of the first clasp member and the overhang of the second clasp member. The overhang is sized to receive the first portion of the first member to align the first magnet and the metallic component for magnetic interaction therebetween.

25 Claims, 9 Drawing Sheets

(56) References Cited

U.S. PATENT DOCUMENTS

| | | | | |
|---|---|---|---|---|
| 2007/0028429 | A1* | 2/2007 | Ishida | A45C 13/1069<br>24/303 |
| 2007/0277353 | A1 | 12/2007 | Kondo et al. | |
| 2011/0083254 | A1* | 4/2011 | Trutna | A41F 1/002<br>2/326 |
| 2012/0180197 | A1 | 7/2012 | Cosky | |
| 2012/0216374 | A1* | 8/2012 | Manuello | A41F 1/002<br>24/303 |
| 2014/0000312 | A1 | 1/2014 | Nicolas et al. | |
| 2014/0143985 | A1 | 5/2014 | Horton | |

* cited by examiner

MAGNETIC FASTENER ASSEMBLIES

TECHNICAL FIELD

The present disclosure relates to magnetic assemblies for fastening portions of items to one another.

BACKGROUND innovative clasp systems are needed to resolve inconveniences and difficulty experienced by disabled, blind, elderly, or handicapped in closing and/or unfastening clasp systems.

SUMMARY

A clasp assembly includes a first clasp member, a second clasp member, a first magnet, and a metallic component. The first clasp member defines a first cavity sized to receive a first portion of a zipper, and defines a first portion extending over the first cavity. The second clasp member defines a second cavity sized to receive a second portion of the zipper, and defines an overhang. The first magnet is secured to one of the first portion of the first clasp member and the overhang of the second clasp member. The metallic component is secured to another of the first portion of the first clasp member and the overhang of the second clasp member. The overhang is sized to receive the first portion of the first member to align the first magnet and the metallic component for magnetic interaction therebetween. The metallic component may be made of one of a ferromagnetic metallic material, a ferromagnetic metallic material alloy, and a ferrite material. The zipper may be mounted to one of a garment, a bag, an apparel item, a satchel, a backpack, a rucksack, a schoolbag, a dress shirt, a blouse, a coat, luggage, a shoe, a tent, and a sleeping bag. A first series of first clasp members and a second series of second clasp members may be arranged with one another to encase substantially the zipper. The first cavity and the second cavity may each be further defined by first and second lips extending toward one another. The lips may be sized to grip the portion of the zipper for securement within the cavity. The first clasp member may further define a first well sized to receive the magnet or the metallic component. The second clasp member further may define a second well sized to receive the magnet or the metallic component.

A clasp assembly includes a first clasp member, a second clasp member, and a first magnet. The first clasp member includes a first portion defining an upper grip flange, and includes a second portion defining a first cavity. The second clasp member is sized for positioning between the upper grip flange and the second portion of the first clasp member, and defines a second cavity. The first magnet is secured to one of the first portion of the first clasp member and the second clasp member above the cavity. The clasp member that does not include the first magnet is metallic. Each of the cavities is sized to receive a portion of a zipper of an item for securing thereto. The first clasp member and the second clasp member are arranged with one another on the zipper to align the first magnet for magnetic interaction with the metallic clasp member. A metallic component may be secured to one of the first portion of the first clasp member or the second clasp member above the cavity. The first clasp member and the second clasp member may further be arranged with one another to align the first magnet and the metallic component for magnetic interaction therebetween. A second magnet may be secured to one of the first portion of the first clasp member or the second clasp member above the cavity. The first member and the second clasp member may further be arranged with one another to align the first magnet and the second magnet for magnetic interaction therebetween. The item may be one of a garment, a bag, an apparel item, a satchel, a backpack, a rucksack, a schoolbag, a dress shirt, a blouse, a coat, luggage, a shoe, a tent, and a sleeping bag. A first series of first clasp members and a second series of second clasp members may be arranged with one another to encase substantially the zipper. The first series of first clasp members may be formed as a single component. The second series of second clasp members may be formed as a single component. The first series of first clasp members may be individual components secured to one another via a first tether. The second series of second clasp members may be individual components secured to one another via a second tether.

A magnetic button assembly includes a first member and a second member. The first member includes first mount portion, one or more first receiving wells, and one or more extension members extending from a lower surface. The second member includes one or more second receiving wells and one or more arms defining a space between one another sized to receive one of the one or more extension members. The second member defines a button well sized to receive a portion of a button. The first member and the second member are arranged with one another such that the first receiving wells are aligned with the second receiving wells when the extensions are positioned within the spaces between the arms. The second member may include a slot sized to receive a stem of the button. The one or more arms may extend from the slot in a radial array. One or more first magnets may be disposed within the one or more first receiving wells and one or more second magnets may be disposed within the one or more second receiving wells. One or more metallic components may be disposed within one of the first receiving wells or the second receiving wells and a magnet may be disposed in the other of the receiving wells to magnetically interact the first member and the second member. One of the first member and the second member may be of a metallic material. One or more magnets may be disposed with the receiving wells of the non-metallic member. The first member may define a surface sized for a logo or advertisement.

A magnetic button assembly includes a first member, a second member, and a first magnet. The first member includes a first upper portion, a first lower portion, and a shaft extending between the portions sized to extend through a button through-hole of an item. The first member defines a first receiving well and a second receiving well. The second member includes a second lower portion with a pin extending therefrom to pierce the item and a second upper portion defining a channel sized to receive the pin and an annular well. The first magnet is sized for disposal within the second receiving well or the annular well. One of the first member and the second member is metallic. The first receiving well is sized to receive the second upper portion such that the first magnet is aligned for magnetic interaction with the metallic member to secure two portions of the item to one another. The item may be one of a garment, a bag, an apparel item, a satchel, a backpack, a rucksack, a schoolbag, a dress shirt, a blouse, a coat, luggage, a shoe, a tent, and a sleeping bag. A second magnet may be sized for disposal within the second receiving well or the annular well in which the first magnet is not disposed. The magnets may be aligned with one another when the second upper portion of the second member is disposed within the first receiving well.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ embodiments of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
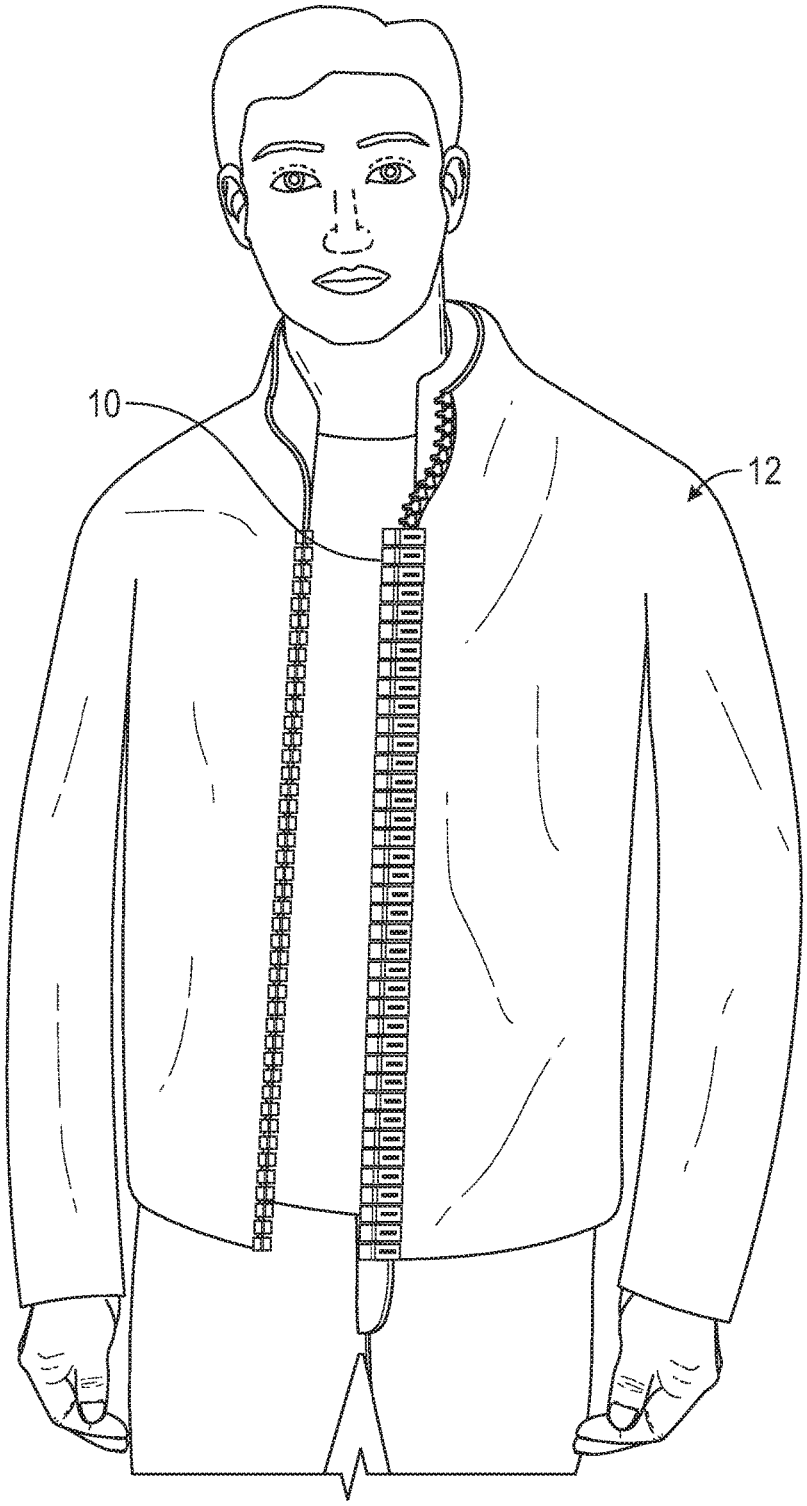
FIG. 1 is a perspective view of an example of a garment and a clasp assembly.
Figure 2:
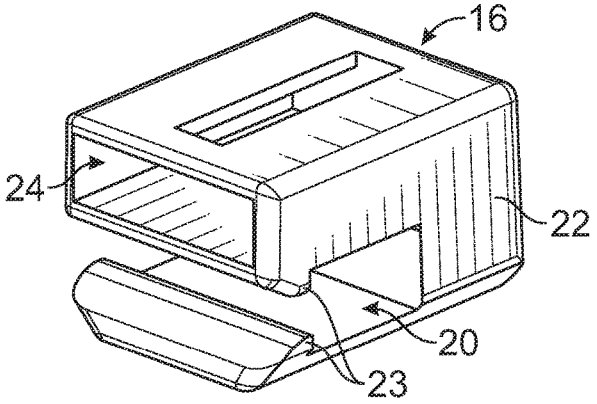
FIG. 2 is a perspective view of an example of a first component of the clasp assembly of FIG. 1.
Figure 3:
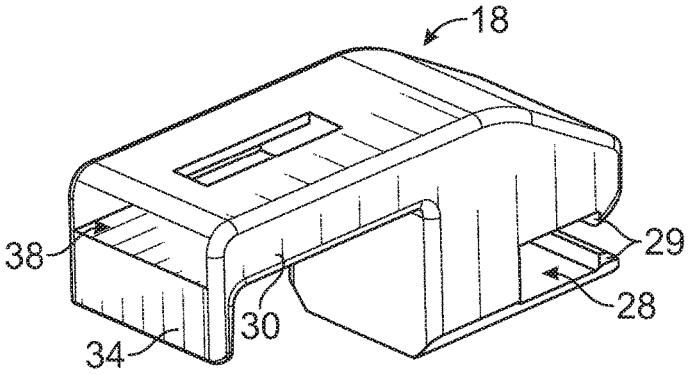
FIG. 3 is a perspective view of an example of a second component of the clasp assembly of FIG. 1.

FIG. 1 shows an example of a clasp assembly mounted to a garment, referred to generally as a clasp assembly 10 and a garment 12 herein. The clasp assembly 10 may be an assembly mounted to a zipper of a garment 12 or may be integrated with the garment 12. Examples of the garment 12 include a shirt or jacket. The clasp assembly 10 may also be mounted to other types of items, such as other types of apparel, handbags, satchels, backpacks, rucksacks, schoolbags, dress shirts, blouses, coats, jackets, leather goods, luggage, shoes, tents, and sleeping bags.

For example and additionally referring to FIGS. 2 through 5B, the clasp assembly 10 may include a first clasp member 16 and a second clasp member 18. The clasp members include components to facilitate a removable attachment to one another. The clasp members may be of a material suitable for injection molding, such as polymers, resins, nylon, polypropylene, high density polyethylene, polycarbonate, acrylonitrile Butadiene Styrene (ABS), Polycarbonate/ABS Alloy, polystyrene, or thermoplastic elastomers. The first clasp member 16 may define a first cavity 20 and include an upper portion 22. The first cavity 20 may be sized to receive a portion of a zipper or may be sized to receive a portion of a garment. A first pair of lips 23 may extend toward one another to further define the first cavity 20. The first pair of lips 23 may be sized to grip the garment 12 to assist in securing the first clasp member 16 to the garment 12. For example, the first pair of lips 23 may assist in securing the first clasp member 16 to a portion of a zipper on the garment 12. The upper portion 22 may define a first well 24 sized to receive a metallic component or a magnet.

The second clasp member 18 may define a second cavity 28 and include an overhang 30 including a ledge 34. The second cavity 28 may be sized to receive a portion of a zipper or may be sized to receive a portion of a garment or other item as described above. A second pair of lips 29 may extend toward one another to further define the second cavity 28. The second pair of lips 29 may be sized to grip the garment 12 to assist in securing the second clasp member 18 to the garment 12. The overhang 30 may define a second well 38 sized to receive a metallic component or magnet. The overhang 30 and the ledge 34 may be sized to receive a portion, such as the upper portion 22, of the first clasp member 16 such that the first well 24 and the second well 38 are aligned with one another.

Figure 4:
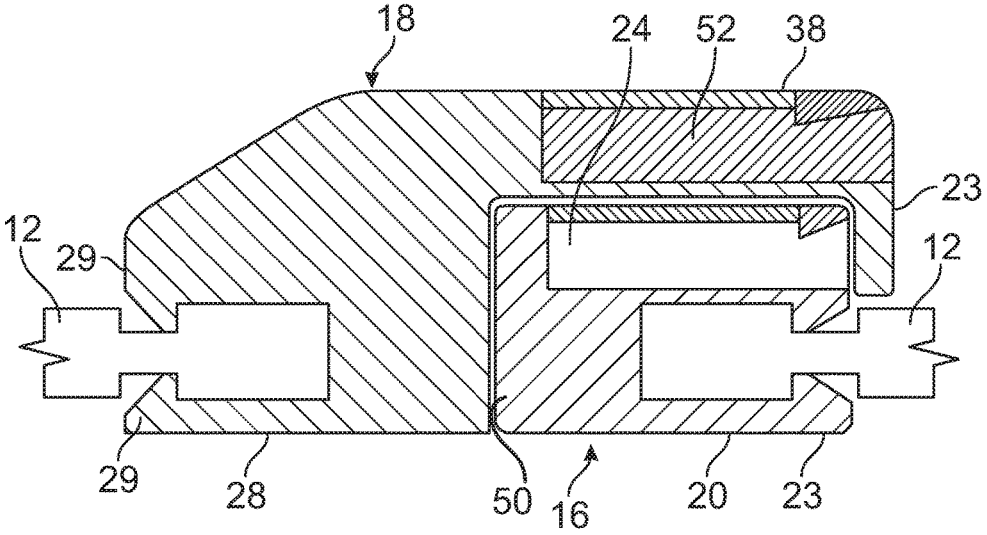
FIG. 4 is a side view, in cross-section, of the components of FIGS. 2 and 3 shown mated with one another and mounted to the garment of FIG. 1.

FIG. 4 shows a cross-section of a portion of the clasp assembly 10 in which the first well 24 and the second well 38 are shown aligned with one another. In this example, the first well 24 is shown with a first component 50 disposed therein and the second well 38 is shown with a second component 52 disposed therein. The first component 50 and the second component 52 may have a magnetic relationship therebetween. For example, the first component 50 may be a first magnet or a first metallic component and the second component 52 may be a second magnet or a second metallic component. If both the first component 50 and the second component 52 are magnets, they may be arranged with one another to facilitate the magnetic interaction therebetween.

Alternatively, if one of the first component 50 and the second component 52 is a metallic component, the other may be a magnet such that the magnetic interaction secures the first clasp member 16 to the second clasp member 18. As another example, the first clasp member 16 or the second clasp member 18 may be made of a metallic material having magnetic characteristics such that only one of the first component 50 or the second component 52 is a magnet. Examples of metallic materials including magnetic characteristics are ferromagnetic metallic materials and their alloys and ferrites. As such, the first clasp member 16 and the second clasp member 18 may assist in securing two portions of the garment 12 to one another. For example, a series of first clasp members 16 and second clasp members 18 may be aligned with one another to secure opposing portions of the garment 12.

Figure 5:
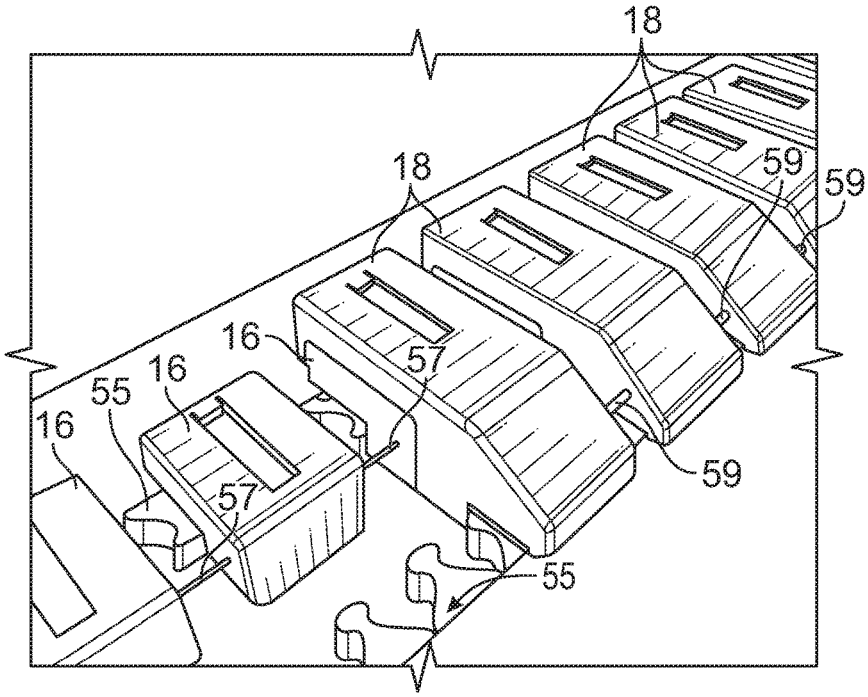
FIG. 5 is a perspective view of the clasp assembly of FIG. 1 showing a series of the first components of FIG. 2 mated with the second components of FIG. 3.

FIG. 5 shows a series of the first clasp members 16 mated with the second clasp members 18 on the garment 12. As described above, a portion of the zipper 55 is shown disposed within the first cavity 20 of the first clasp member 16 and a portion of the zipper 55 is shown disposed within the second cavity 28 of the second clasp member 18. A tether 57 may extend between each of the first clasp members 16 to connect the first clasp members 16 to one another. The tether 57 may assist in aligning the first clasp members 16 for securing to the second clasp members 18. A tether 59 may extend between each of the second clasp members 18 to connect the second clasp members 18 to one another. The tether 59 may assist in aligning the second clasp members 18 for securing to the first clasp members 16.

Figure 6:
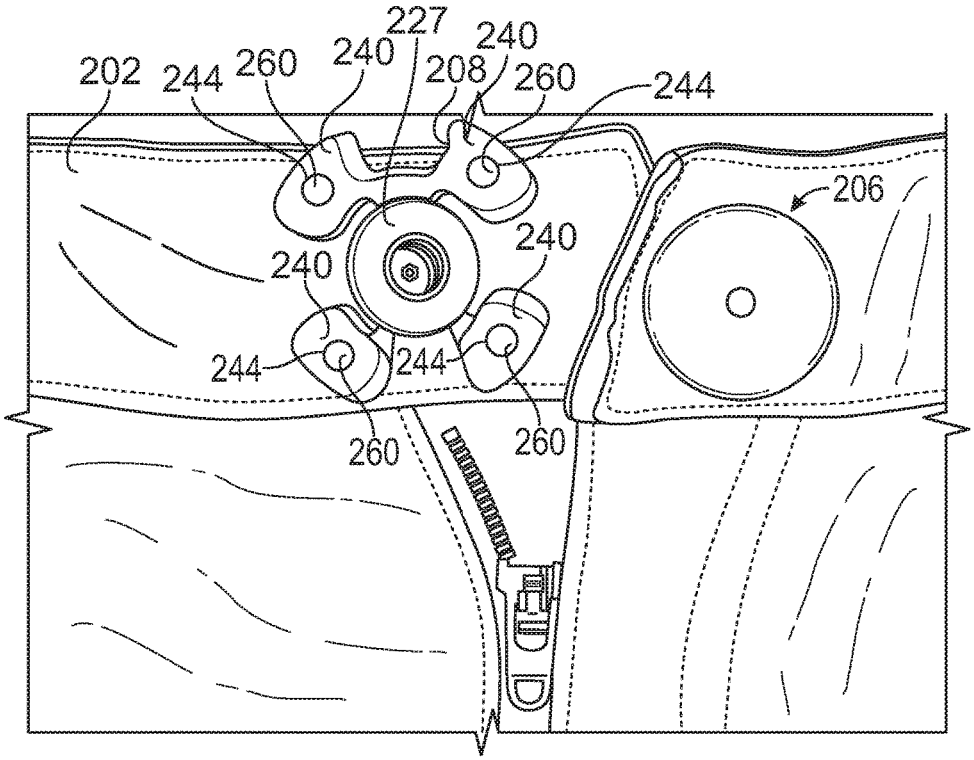
FIG. 6 is a perspective view of an example of a garment and a button assembly.
Figure 7:
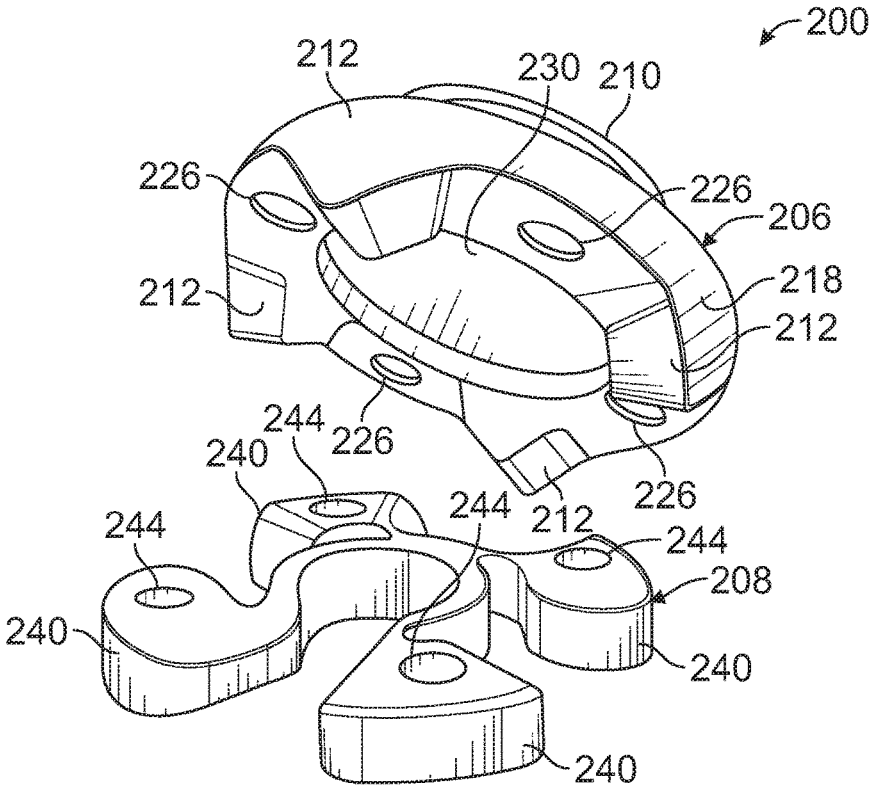
FIG. 7 is a perspective view of an example of two components of the button assembly of FIG. 6 shown separated from one another.

FIG. 6 shows an example of a button assembly mounted to a garment referred to generally as a button assembly 200 and a garment 202 herein. The garment 202 may be, for example, a pair of pants. Referring additionally to FIGS. 7 through 14, the button assembly 200 may include a first member 206 and a second member 208. The first member 206 may include an upper mount portion 210 having one or more extension members 212 and an upper body portion 218. The upper mount portion 210 may be mounted to a shaft 220 extending from the upper body portion 218. The upper mount portion 210 may assist in securing the first member 206 to an item, such as the garment 202. The upper mount portion 210 may define a surface sized for a logo or advertisement.

For example, the upper mount portion 210 may be spaced from the upper body portion 218 such that the first member 206 is secured to the garment 202 via a button through-hole. The shaft 220 may be sized to extend through the button through-hole. The upper mount portion 210 and the upper body portion 218 may be sized to extend outward from the shaft 220 to retain the first member 206 against the garment 202. The upper body portion 218 may define one or more receiving wells 226 sized to receive a magnet or metallic component. The upper body portion may also define a button well 230 sized to receive at least a portion of a button 227 of the garment 202. The second member 208 may be sized to rotate freely about the button 227 when mounted thereto.

Figure 8:
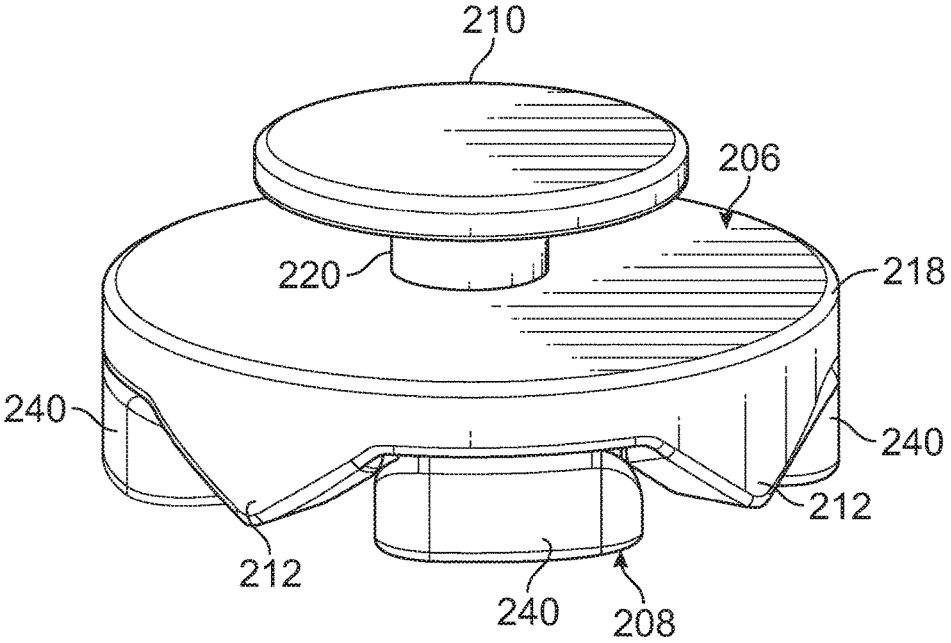
FIG. 8 is a perspective view of the two components of FIG. 7 shown mated with one another.
Figure 11:
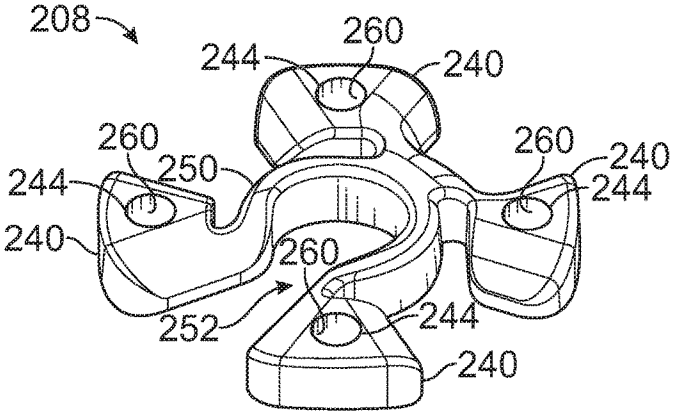
FIG. 11 is a perspective view of one of the components of FIG. 7.
Figure 12:
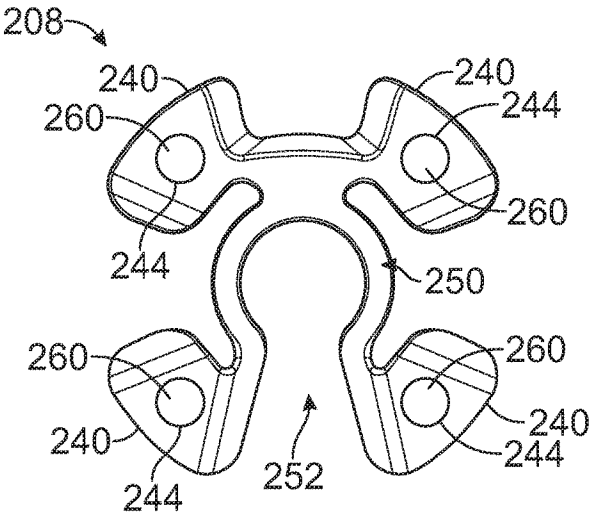
FIG. 12 is a bottom view of the component of FIG. 7.
Figure 9:
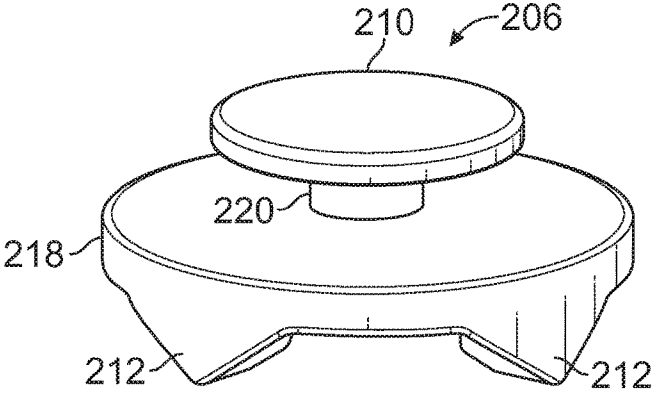
FIG. 9 is a perspective view of one of the components of FIG. 7.
Figure 10:
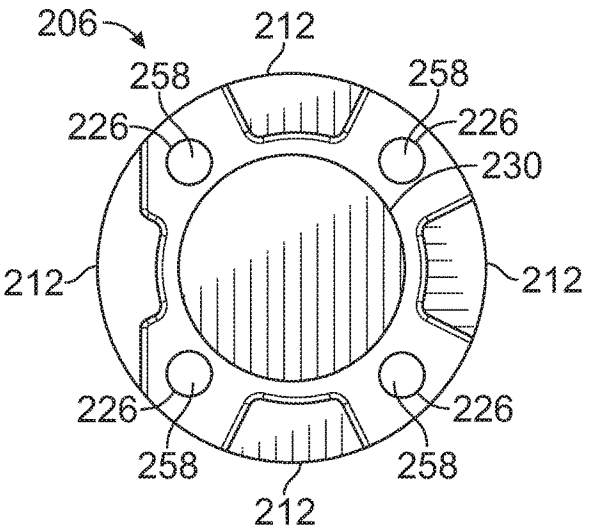
FIG. 10 is a bottom view of the component of FIG. 9.
Figure 13:
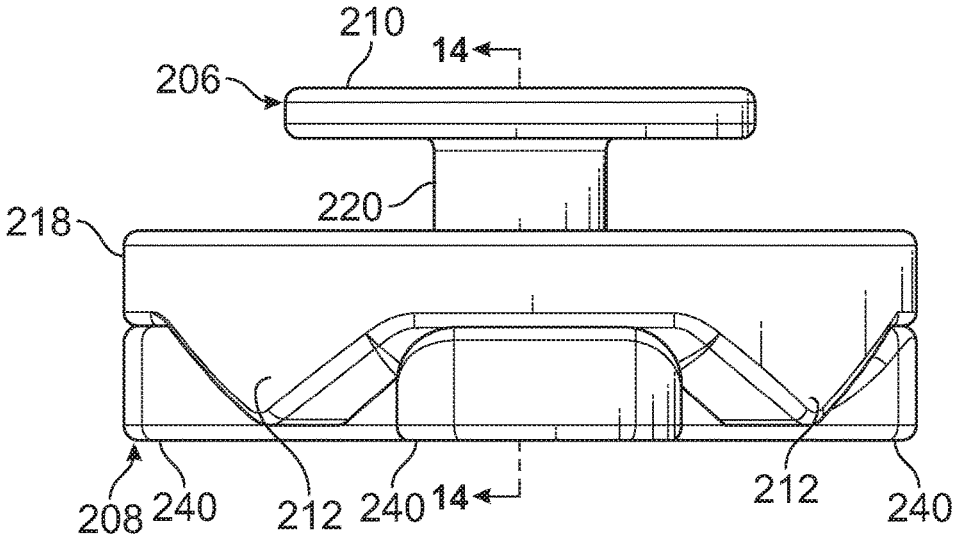
FIG. 13 is a side view of the components of FIG. 7 shown mated with one another.

The second member 208 may include one or more arms 240. The one or more arms 240 may be spaced from one another such that the extension members 212 may be disposed therebetween when the first member 206 and the second member 208 are secured to one another as shown in FIG. 8. Each of the arms 240 may define a receiving well 244. The receiving wells 244 may be sized to receive a magnet or a metallic component. The arms 240 and the extension members 212 are arranged with one another such that the receiving wells 226 and the receiving wells 244 are aligned with one another when the first member 206 and the second member 208 are mated with one another.

Figure 14:
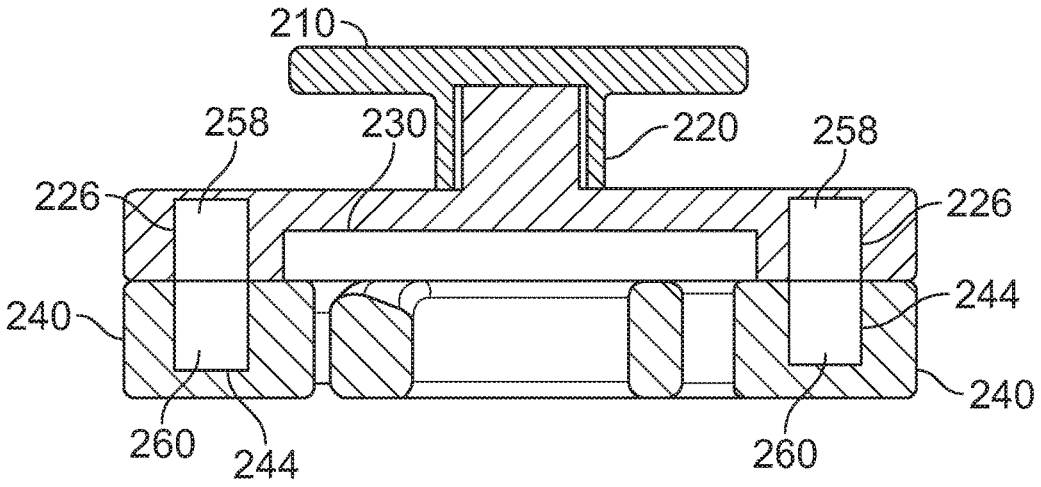
FIG. 14 is a side view, in cross-section, of the components of FIG. 13.

The second member 208 may include a horseshoe member 250. The horseshoe member 250 may be flexible to assist in securing the second member 208 to the button 227. The one or more arms 240 may extend from the horseshoe member 250 in a radial array. The horseshoe member 250 defines a slot 252 sized to receive a stem of the button 227 of the garment 202 for an interference fit. For example, FIG. 6 shows the second member 208 mounted to the button 227. FIG. 14 shows a side view, in cross-section, of the first member 206 and the second member 208 mated to one another. In this view, the receiving wells 226 and the receiving wells 244 are shown aligned with one another.

A first component 258 is shown disposed within the first receiving wells 226 and a second component 260 is shown disposed within the receiving wells 244. The first component 258 and the second component 260 may have a magnetic relationship therebetween. For example, the first component 258 may be a first magnet or a first metallic component and the second component 260 may be a second magnet or a second metallic component. If both the first component 258 and the second component 260 are magnets, they may be arranged with one another to facilitate the magnetic interaction therebetween. Alternatively, if one of the first component 258 and the second component 260 is a metallic component, the other may be a magnet such that the magnetic interaction secures the first member 206 to the second member 208. As another example, the first member 206 or the second member 208 may be made of a metallic material such that only one of the first component 258 or the second component 260 is a magnet. As such, the first member 206 and the second member 208 may assist in securing two portions of the garment 202 to one another.

Figure 15:
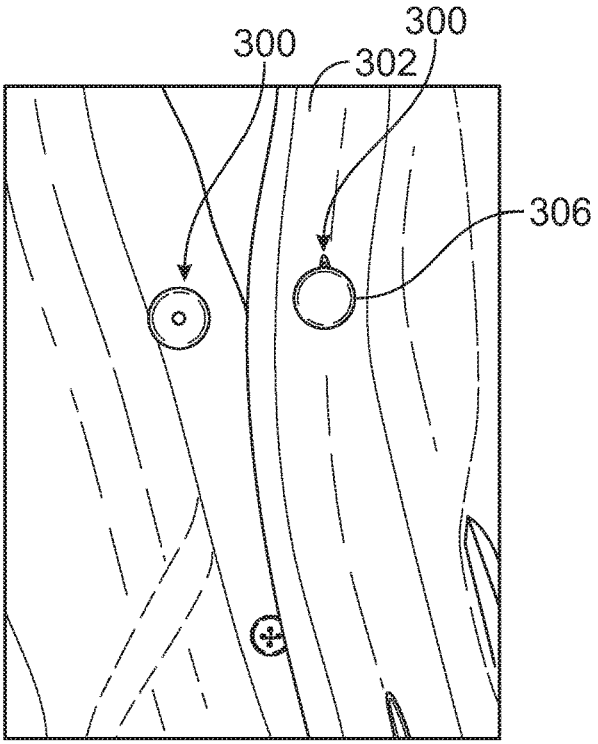
FIG. 15 is a perspective view of an example of a garment and a button assembly.
Figure 16:
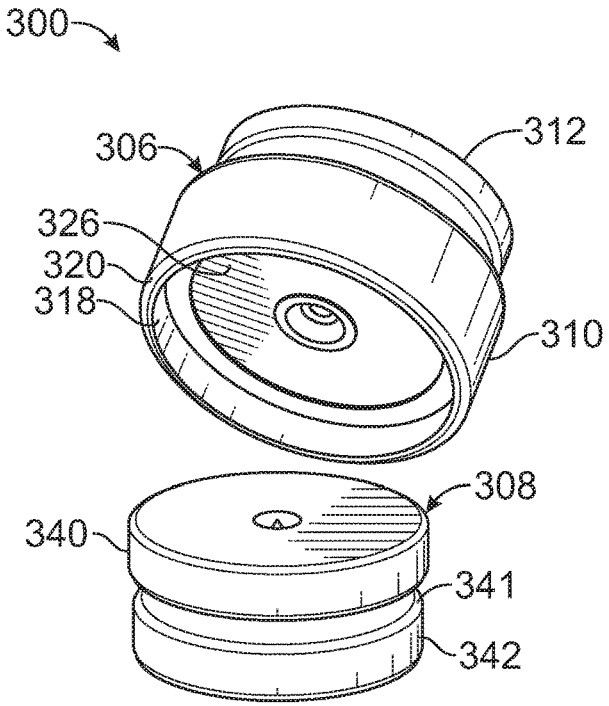
FIG. 16 is a perspective view of an example of two components of the button assembly of FIG. 15 shown separated from one another.
Figure 17:
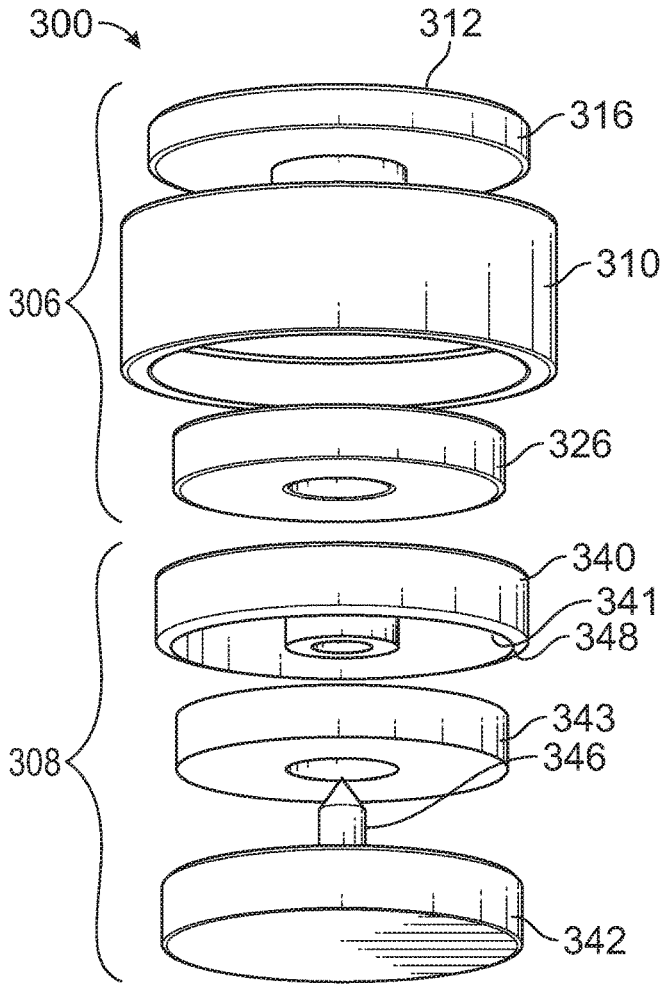
FIG. 17 is an exploded view of the two components of FIG. 15.
Figure 18:
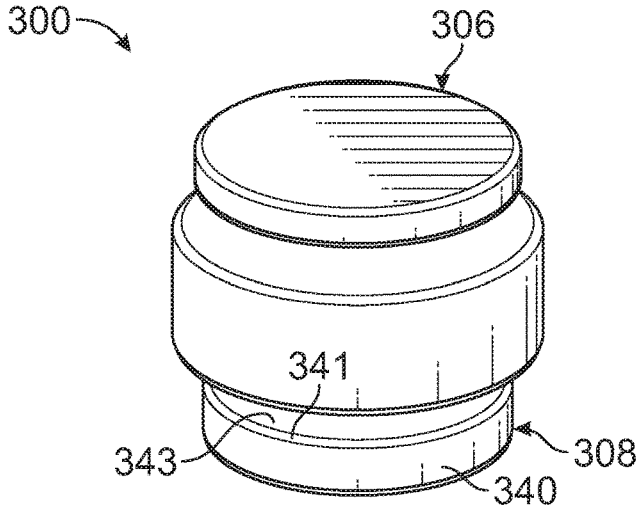
FIG. 18 is perspective view of the two components of FIG. 16 shown mated with one another.

FIG. 15 shows another example of a button assembly mounted to a garment referred to generally as a button assembly 300 and a garment 302 herein. The garment 302 may be, for example, a shirt, shorts, or cufflinks. Referring additionally to FIGS. 16 through 19, the button assembly 300 may include a first member 306 and a second member 308. The first member 306 may include a first lower body 310 and a first upper body 312 mounted to a shaft 316 extending between the first lower body 310 and the first upper body 312. The first lower body 310 and the first upper body 312 may be spaced from one another to accommodate a portion of the garment 302. For example, the shaft 316 may extend through a through-hole on the garment 302 to assist in securing the first member to the garment 302. The first upper body 312 may define a substantially circular shape such that the first member 306 is retained against the garment 302.

The first lower body 310 may define a button well 318 and a receiving well 320. The button well 318 may be sized to receive a portion of the second member 308. The receiving well 320 may be sized to receive a component such as a magnet or a metallic object. For example, a first component 326 may be secured within the receiving well 320. The first component 326 may be a magnet or metallic object to assist in securing the first member 306 and the second member 308 to one another.

The second member 308 may include a second upper body 340 and a second lower body 342. The second upper body 340 may define an annular shaped or ring-shaped receiving well 341. The receiving well 341 may be sized to receive a component such as a magnet or a metallic object. For example, a second component 343 may define a washer shape or ring shape, may be sized for disposal within the receiving well 341, and may assist in securing the first member 306 to the second member 308.

The second upper body 340 and the second lower body 342 may be selectively secured to one another. A pin 346 extends from the second lower body 342. It is contemplated that the pin 346 may be of various shapes including square or hexagonal and may be made of metal or plastic. The second upper body 340 defines a channel 348 sized to receive the pin 346. The pin 346 or the channel 348 may define a feature to assist in securing the pin 346 within the channel 348. The pin 346 may be sized to pierce the garment 302 at a button location thereupon. For example, a button of the garment 302 may become dislodged. The location where the button was dislodged may provide a location for the second member 308 to be secured to the garment 302. Once extending through the garment 302, the pin 346 may be inserted within the channel 348 to secure the second lower body 342 to the second upper body 340.

The first component 326 and the second component 343 may be arranged within their respective members such that the components are aligned with one another for magnetic interaction when the first member 306 and the second member 308 are mounted to one another. For example, if both the first component 326 and the second component 343 are magnets, they may be arranged with one another to facilitate magnetic interaction therebetween. Alternatively, if one of the first component 326 and the second component 343 is a metallic component, the other may be a magnet such that the magnetic interaction secures the first member 306 to the second member 308. As another example, the first member 306 or the second member 308 may be made of a metallic material such that only one of the first component 326 or the second component 343 is a magnet. As such, the first member 306 and the second member 308 may assist in securing two portions of the garment 302 to one another.

Figure 19:
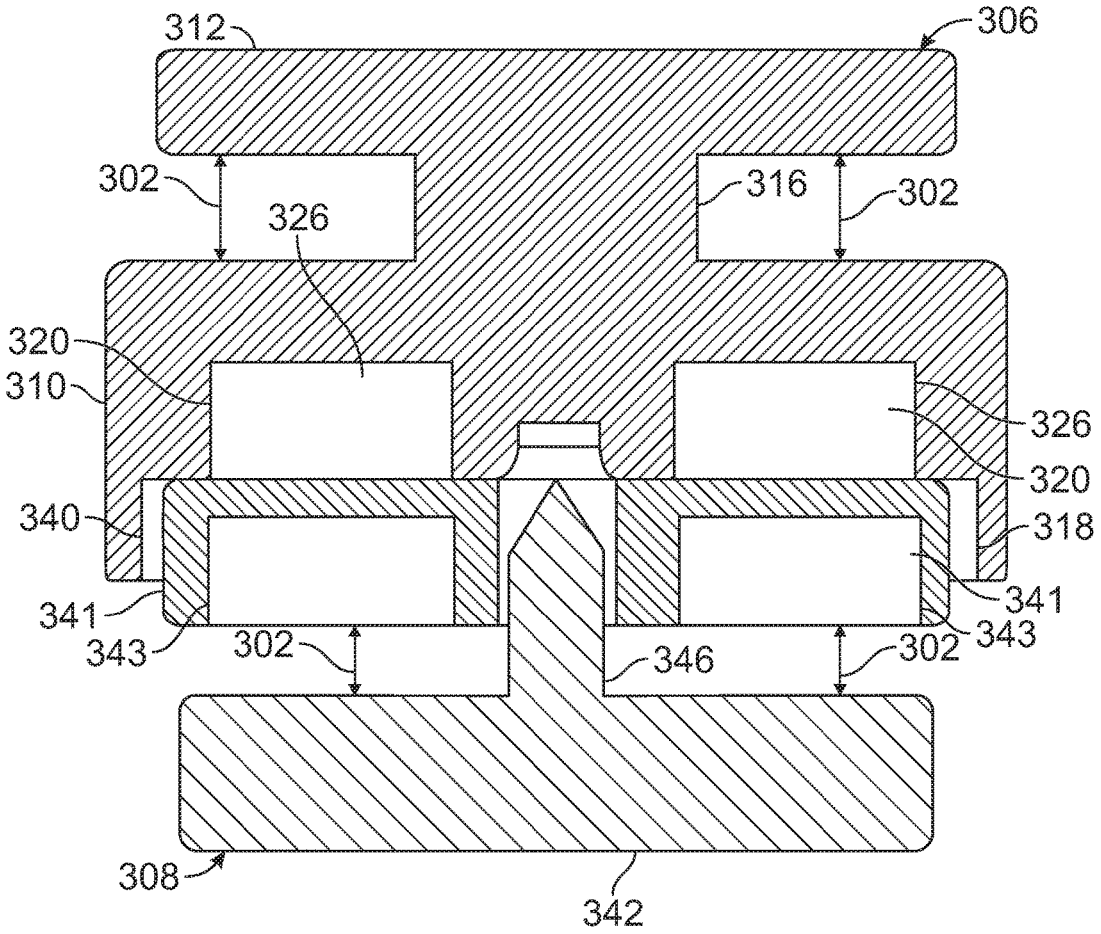
FIG. 19 is a side view, in cross-section, of the two components of FIG. 16.

FIG. 19 shows a cross-section of the first member 306 and the second member 308 mounted to one another. As shown, the first member 306 and the second member 308 are arranged with one another such that the first components 326 are aligned with respective second components 343 to facilitate a magnetic interaction therebetween. The second upper body 340 is shown disposed within the button well 318. The second lower body 342 is shown secured to the second upper body 340. The pin 346 is shown extending through the garment 302 and the shaft 316 is shown extending through the through-hole of the garment 302 such that the button assembly 300 is mounted thereto.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to marketability, appearance, consistency, robustness, customer acceptability, reliability, accuracy, etc. As such, embodiments described as less desirable than other embodiments or prior art implementations with respect to one or more characteristics are not outside the scope of the disclosure and can be desirable for particular applications.

What is claimed is:

1. A clasp assembly comprising:

a first clasp member defining a first cavity configured for retrofitting and mounting upon a first portion of an existing zipper, and a first portion extending over the first cavity;

a second clasp member defining a second cavity configured for retrofitting and mounting upon a second portion of the existing zipper, and an overhang;

a first magnet secured to one of the first portion of the first clasp member and the overhang of the second clasp member; and a metallic component secured to another of the first portion of the first clasp member and the overhang of the second clasp member, wherein the overhang is sized to receive the first portion of the first clasp member to align the first magnet and the metallic component for magnetic interaction therebetween.

2. The assembly of claim 1, wherein the metallic component is made of one of a ferromagnetic metallic material, a ferromagnetic metallic material alloy, and a ferrite material.

3. The assembly of claim 1, wherein the existing zipper is mounted to one of a garment, a bag, an apparel item, a satchel, a backpack, a rucksack, a schoolbag, a dress shirt, a blouse, a coat, luggage, a shoe, a tent, and a sleeping bag.

4. The assembly of claim 1 further comprising a first series of first clasp members and a second series of second clasp members arranged with one another to encase substantially the existing zipper.

5. The assembly of claim 1, wherein the first cavity and the second cavity are each further defined by first and second lips extending toward one another, and wherein the lips are sized to grip the first portion or the second portion of the existing zipper for securement within the respective cavity.

6. The assembly of claim 1, wherein the first clasp member further defines a first well sized to receive the first magnet or the metallic component.

7. The assembly of claim 1, wherein the second clasp member further defines a second well sized to receive the first magnet or the metallic component.

8. A clasp assembly comprising:

a first clasp member including a first portion defining an upper grip flange, and including a second portion defining a first cavity;

a second clasp member sized for positioning between the upper grip flange and the second portion of the first clasp member, and defining a second cavity; and a first magnet secured to one of the first portion of the first clasp member and the second clasp member above one of the cavities, wherein one of the clasp members that does not include the first magnet is metallic, and wherein each of the clasp members is configured for respective cavities to receive a portion of an existing zipper of an item for securing thereto, and wherein the first clasp member and the second clasp member are arranged with one another on the zipper to align the first magnet for magnetic interaction with the metallic clasp member.

9. The assembly of claim 8 further comprising a metallic component secured to one of the first portion of the first clasp member or the second clasp member above the respective cavity, wherein the first clasp member and the second clasp member are further arranged with one another to align the first magnet and the metallic component for magnetic interaction therebetween.

10. The assembly of claim 8 further comprising a second magnet, wherein the second magnet is secured to one of the first portion of the first clasp member or the second clasp member above the respective cavity, and wherein the first clasp member and the second clasp member are further arranged with one another to align the first magnet and the second magnet for magnetic interaction therebetween.

11. The assembly of claim 8, wherein the item is one of a garment, a bag, an apparel item, a satchel, a backpack, a rucksack, a schoolbag, a dress shirt, a blouse, a coat, luggage, a shoe, a tent, and a sleeping bag.

12. The assembly of claim 8 further comprising a first series of first clasp members and a second series of second clasp members arranged with one another to encase substantially the existing zipper.

13. The assembly of claim 12, wherein the first series of first clasp members are formed as a single component, and wherein the second series of second clasp members are formed as a single component.

14. The assembly of claim 12, wherein the first series of first clasp members are individual components secured to one another via a first tether, and wherein the second series of second clasp members are individual components secured to one another via a second tether.

15. A magnetic button assembly comprising:

a first member including a first mount portion, one or more first receiving wells, and one or more extension members extending from a lower surface; and a second member including one or more second receiving wells and one or more arms defining a space between one another sized to receive one of the one or more extension members, and defining a button well configured for retrofitting and mounting upon a portion of an existing button, wherein the first member and the second member are arranged with one another such that the first receiving wells are aligned with the second receiving wells when the extensions are positioned within the spaces between the arms.

16. The assembly of claim 15, wherein the second member includes a slot sized to receive a stem of the existing button.

17. The assembly of claim 16, wherein the one or more arms extend from the slot in a radial array.

18. The assembly of claim 15 further comprising one or more first magnets disposed within the one or more first receiving wells and one or more second magnets disposed within the one or more second receiving wells.

19. The assembly of claim 15 further comprising:

one or more metallic components disposed within one of the first receiving wells or the second receiving wells; and a magnet disposed in another of the receiving wells to magnetically interact the first member and the second member.

20. The assembly of claim 15, wherein one of the first member and the second member is of a metallic material, and wherein one or more magnets are disposed within the receiving wells of the non-metallic member.

21. The assembly of claim 15, wherein the first member defines a surface sized for a logo or advertisement.

22. A magnetic button assembly comprising:

a first member including a first upper portion, a first lower portion, and a shaft extending between the portions configured for retrofitting and extending through a button through-hole of an existing item on a first flap, and defining a first receiving well and a second receiving well;

a second member including a second lower portion with a pin extending therefrom to pierce the existing item at a second flap and a second upper portion defining a channel sized to receive the pin and an annular well; and a first magnet sized for disposal within the second receiving well or the annular well, wherein one of the first member and the second member is metallic, and wherein the first receiving well is sized to receive the second upper portion such that the first magnet is aligned for magnetic interaction with the metallic member to secure the first flap and the second flap of the existing item to one another.

23. The assembly of claim 22, wherein the existing item is one of a garment, a bag, an apparel item, a satchel, a backpack, a rucksack, a schoolbag, a dress shirt, a blouse, a coat, luggage, a shoe, a tent, and a sleeping bag.

24. The assembly of claim 22 further comprising a second magnet sized for disposal within the second receiving well or the annular shaped well in which the first magnet is not disposed, wherein the magnets are aligned with one another when the second upper portion of the second member is disposed within the first receiving well.

25. The assembly of claim 1, wherein the first clasp member and the second clasp member are arranged with one another so the first magnet and the metallic component are aligned in a direction perpendicular to a direction defined by the existing zipper when the overhang receives the first portion.

* * * * *